US006571750B2

(12) United States Patent
Gonzalez

(10) Patent No.: US 6,571,750 B2
(45) Date of Patent: Jun. 3, 2003

(54) SMART FUEL INJECTION SYSTEM FOR AN AUTOMOBILE

(76) Inventor: Jorge E. Gonzalez, 109 Paloma Dr., Coral Gables, FL (US) 33143

( * ) Notice: Subject to any disclaimer, the term of this patent is extended or adjusted under 35 U.S.C. 154(b) by 0 days.

(21) Appl. No.: 09/981,991

(22) Filed: Oct. 18, 2001

(65) Prior Publication Data

US 2003/0029391 A1 Feb. 13, 2003

Related U.S. Application Data

(60) Provisional application No. 60/311,747, filed on Aug. 11, 2001.

(51) Int. Cl.[7] ..... F01P 7/14
(52) U.S. Cl. ..... 123/41.1
(58) Field of Search ..... 123/478, 479, 123/480, 41.1

(56) References Cited

U.S. PATENT DOCUMENTS 5,494,005 A * 2/1996 Saur ..... 123/41.1
5,755,207 A * 5/1998 Kushibe ..... 123/478

* cited by examiner

*Primary Examiner*—Willis R. Wolfe
*Assistant Examiner*—Hyder Ali
(74) *Attorney, Agent, or Firm*—Gold & Rizvi, P.A.; H. John Rizvi; Glenn E. Gold

(57) ABSTRACT

A smart fuel injection system for an automobile is provided for use with a multi-port engine wherein engine coolant is utilized, as well as temperature readings within the head of each of the injector nozzles in the cylinders of the engine and a variety of other known engine performance and operating condition data, to carefully adjust and maintain the air-to-fuel ratio of the engine and maximize fuel efficiency. The system includes a multi-cylinder engine having at least one fuel injector, an engine control unit, a plurality of sensors for measuring automobile operating conditions, and coolant control means for continuously regulate the quantity of engine coolant passing to the engine.

5 Claims, 10 Drawing Sheets

SMART FUEL INJECTION SYSTEM FOR AN AUTOMOBILE

CROSS REFERENCE TO RELATED APPLICATION

This application claims the benefit of U.S. Provisional Patent Application Ser. No. 60/311,747 filed Aug. 11, 2001, which is incorporated by reference herein in its entirety.

BACKGROUND OF THE INVENTION

1. Field of the Invention

The present invention relates generally to fuel injection systems for automobiles, and more particularly to an automobile fuel injection system designed for increasing the overall fuel efficiency of automobiles.

2. Description of the Prior Art

Fuel injection systems have replaced carburetors as the predominant type of fuel system used in automobiles. In response to increasingly stricter automobile emissions requirements, as well as to keep up with evolving fuel efficiency laws and regulations, electronic fuel injection systems have undergone significant changes since their inception. Many of the changes in the design and configuration have related to the air-to-fuel ratio. Particularly, in any electronic fuel injection system, careful control of the air-to-fuel ratio is required to maximize power and optimize fuel efficiency.

In typical multi-port fuel injection systems, the amount of fuel supplied to the engine is determined by the amount of time the nozzles of the fuel injectors remain open, also referred to as the "pulse width." A lean air-to-fuel ratio is obtained by minimizing the pulse width. Likewise, a greater pulse width results in a richer air-to-fuel mixture. In conventional automobile engines, an engine control unit calculates an appropriate pulse width based upon a variety of carefully monitored engine performance and operating conditions such as engine temperature, the amount of air entering the throttle valve, the amount of oxygen in the exhaust, fuel pressure, throttle position, intake manifold air pressure, engine speed, and the like. The engine control unit utilizes this information to calculate a specific pulse width for the given operating conditions in order to maximize power and fuel efficiency.

It is known that for internal combustion engines to run efficiently, the air-to-fuel ratio must be within a range of 8-to-1 and 18.5-to-1 at sea level. The temperature of the cylinder and injector nozzles decreases as the richness in the fuel mixture increases. Conversely, as the fuel mixture becomes leaner, the temperature of the cylinders and injector nozzles increases.

The engine temperature is an important variable in maximizing engine power and fuel economy. Specifically, the temperature in the head of each of the cylinder injector nozzles of an engine has a substantial and direct effect upon the air-to-fuel ratio necessary to maximize power and fuel economy. In existing automotive fuel injection systems, an approximation of the temperature in the head of each of the injector nozzles is obtained by measuring the temperature in the engine chamber. Consequently, electronic fuel injection systems of existing automotive internal combustion engines do not directly measure the specific temperature in the head of each of the injector nozzles within the cylinder of the engine.

Coolant circulation control is limited in conventional liquid-cooled engines by a thermostat having an open and a closed configuration. The function of the thermostat is simply to block the flow of coolant until the engine has sufficiently warmed up.

The thermostat opens to permit engine coolant to flow when the opening temperature reaches a predetermined preset value. In many automobile engines, this value is typically around 199 degrees Fahrenheit. Once the thermostat is open, the coolant flowing through the engine heat intercooler reduces the engine temperature. As the temperature approaches a lower preset value, typically around 175 degrees Fahrenheit, the thermostat closes to stop the flow of coolant circulation.

By allowing an engine to warm up as quickly as possible, the cooling system helps reduce engine wear, deposits and emissions. Once the engine reaches the preset target temperature, however, the thermostats of existing cooling systems open completely to permit coolant flow throughout the engine and throughout the heat exchanger, e.g., the radiator. Once the engine is sufficiently warmed, the thermostats of existing cooling systems remain open as long as the vehicle is running and the engine maintains a minimum temperature. As such, the open/shut configurations of existing cooling systems are not oriented for use in carefully maintaining and adjusting engine temperature so as to maximize power and fuel economy.

Accordingly, there is an established need for a smart fuel injection system overcoming the aforementioned drawbacks and limitations of the prior art. In particular, it would be desirable to provide a smart fuel injection system wherein the engine coolant can be carefully regulated by a coolant valve and, thereby, play an integral part in adjusting and maintaining engine temperature to maximize power and fuel economy. Additionally, a smart fuel injection system is needed that directly measures the temperature in the head of each of the injector nozzles within the cylinder of an engine and utilizes this reading, along with other engine performance and operating condition information, to carefully adjust the air-to-fuel ratio to maximize power and economize fuel.

SUMMARY OF THE INVENTION

The present invention is directed to a smart fuel injection system for automobiles wherein engine coolant, temperature measurements from each cylinder injector nozzle head of an engine, and a variety of other known engine performance and operating condition data are utilized to carefully adjust and maintain the air-to-fuel ratio of the engine so as to maximize power and fuel efficiency.

An object of the present invention is to provide a smart fuel injection system configured to substantially reduce the fuel consumption of an automobile engine.

Another object of the present invention is to provide a smart fuel injection system that directly measures the temperature in each cylinder injector nozzle head of an engine and, subsequently, utilizes this reading, along with other engine performance and operating condition information, to carefully adjust the air-to-fuel ratio to maximize power and fuel economy in an automobile engine.

It is another object of the present invention to provide a smart fuel injection system wherein the engine coolant plays an integral part in adjusting and maintaining engine temperature so as to maximize power and fuel economy in an automobile engine.

It is another object of the present invention to provide a smart fuel injection system wherein the quantity of engine coolant passing to the engine can be carefully controlled with substantial precision during operation of the engine.

It is another object of the present invention to provide a smart fuel injection system operating to minimize, and preferably eliminate, the well-established negative thermal inertia effects in existing automotive system engine blocks.

It is another object of the present invention to provide a smart fuel injection system that can be readily incorporated into an automobile engine design and manufacturing process with minimal additional cost.

It is another object of the present invention to provide a smart fuel injection system capable of substantially reducing the fuel consumption of an automobile engine at a wide range of operating altitudes.

It is another object of the present invention to provide a smart fuel injection system capable of substantially reducing the fuel consumption of an automobile under a wide variety of operating and environmental conditions, such as automobile speed and acceleration, operating altitudes, road gradients, traffic conditions, and the like.

These and other objects, features, and advantages of the present invention will become more readily apparent from the attached drawings and the detailed description of the preferred embodiments, which follow.

In accordance with a first aspect of the invention, a smart fuel injection system for an automobile is provided for use with a multi-port engine wherein the flow rate of engine coolant, temperature measurements within the heads of the cylinder injector nozzles, and other engine performance and operation condition information is utilized to precisely adjust and maintain the air-to-fuel ratio of the engine and to maximize fuel efficiency.

The smart fuel injection system of the present invention includes a multi-cylinder engine having at least one fuel injector, an engine control unit, a plurality of sensors to measure a variety operating conditions, and coolant control means to continuously regulate the volume of engine coolant flowing to the engine.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is generally directed to a smart fuel injection system in which air intake, injection pulse width and coolant circulation are precisely controlled to maintain the heads of the injector nozzles at an optimum temperature in order to achieve and maintain an optimal air-to-fuel ratio.

The invention, as disclosed herein, has been thoroughly tested under a variety of rigorous field conditions and has consistently improved automotive fuel efficiency without significantly sacrificing other important vehicular characteristics such as power, acceleration, and vehicle reliability. A few examples of particular testing conditions and performance results achieved by the smart fuel injection system of the present invention will now be described for illustrative purposes.

The results of the first phase of experimentation were performed in Bogotá, Colombia, and the surrounding area. The average altitude during testing in this area was approximately 7,874 feet above sea level. The vehicle utilized for testing was a 1998 Mazda 323 NT with multiport fuel injection. As an initial measure, this vehicle was test driven 3,896 miles with a calculated fuel efficiency of 28.9 miles/gallon. Subsequent to equipping the vehicle in accordance with the smart fuel injection system of the present invention, a distance of 7,783 miles was test driven with an average fuel efficiency of 34.3 miles/gallon, yielding an improvement in fuel efficiency of approximately 19%.

Similar testing was performed in Palmira, Colombia, resulting approximately in a 23% improvement in the same vehicle's fuel efficiency. The average altitude in this region is 3,609 feet above sea level. A third phase of tests were performed in the Magdalena and Cesar states of Colombia at an average altitude of 1,476 feet and yielded approximately a 27% improvement in fuel efficiency. Additionally, laboratory tests were performed on the vehicle on a roller mechanism in Bogotá, Colombia, using the smart fuel injection system of the present invention and yielded approximately a 21% improvement in the vehicle's fuel efficiency. The differing altitudes demonstrate the successful implementation of the present invention regardless of natural variations in Oxygen supply.

Figure 1:
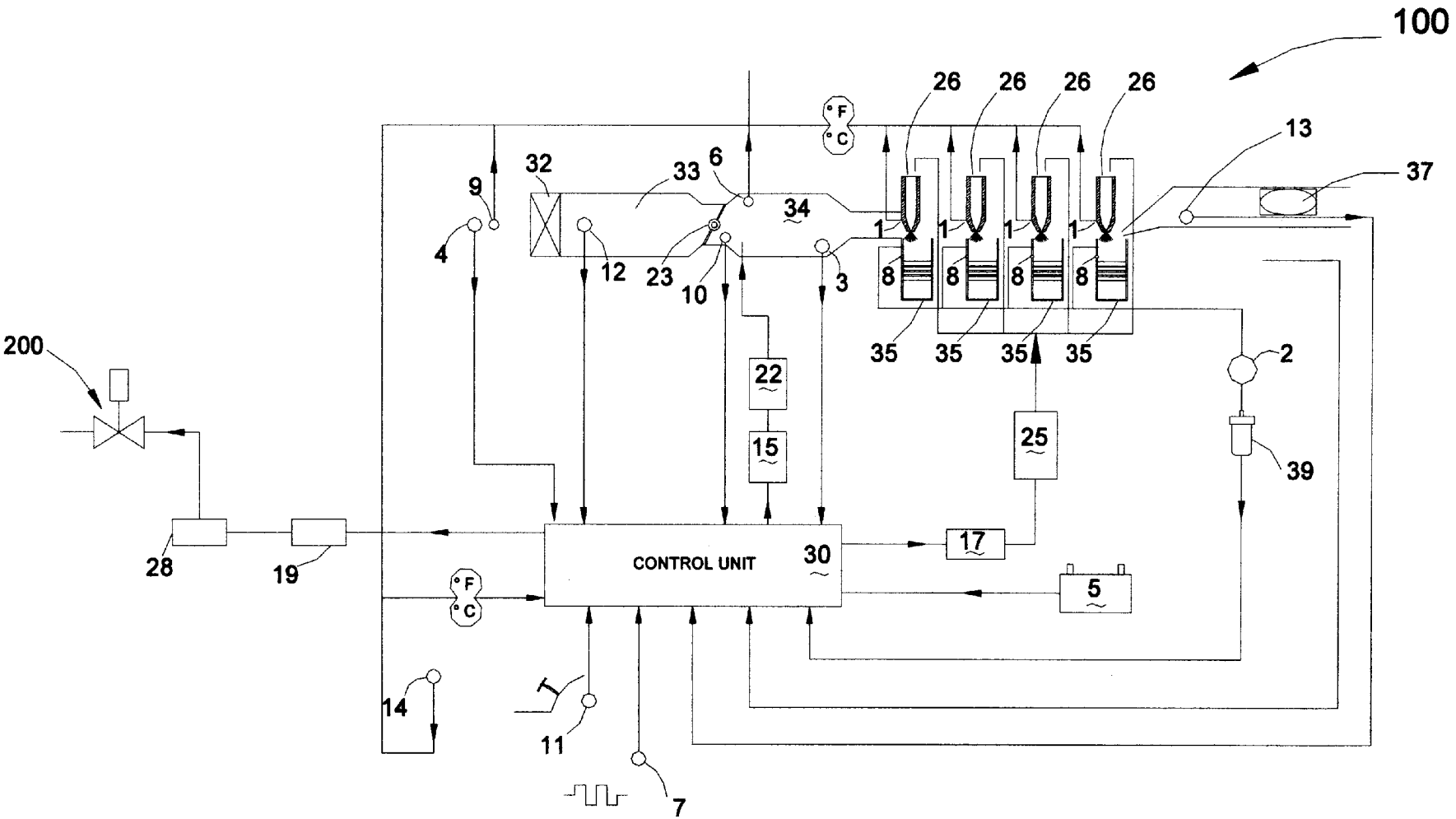
FIG. 1 is a schematic view of the smart fuel injection system for an automobile in accordance with a preferred embodiment of the present invention.

Referring now primarily to FIG. 1, the smart fuel injection system of the present invention is shown generally in schematic form as reference numeral 100. The smart fuel injection system of the present invention includes an engine control unit 30 as shown. As described in more detail herein, the engine control unit 30 communicates with a wide variety of sensors 1–14 located throughout the engine to carefully monitor engine performance and operating conditions and adjusts the air-to-fuel ratio to maximize power and optimize fuel efficiency.

As shown, in a four cylinder internal combustion engine, the air intake 33 occurs through the air filter 32, in the entrance of the air intake manifold 34 where the sensors for the air intake 4, air intake temperature 9, air intake manifold temperature 6, and air flow 12 are preferably located. The air passes through the throttle butterfly switch 10 and the intake manifold 34 where it is mixed with the fuel injected by the injectors 26. In the preferred embodiment, an injector 26 is located in the intake manifold 34 as it leads to each cylinder 35 of the engine. The escape gases are released to the atmosphere through an escape manifold (not shown), the catalytic converter 37, and the escape tube (not shown).

The admission manifold depression sensor 3 is an electronic device configured to change voltage in reference to pressure changes in the intake manifold 34. In the preferred embodiment, injector head temperature sensors 1 are located such that the temperature at the head of each of the injector nozzles of the injectors 26 of each cylinder can be determined. A distributor ignition timing sensor 2 is also preferably incorporated in the distributor ignition 39 as shown in FIG. 1. This sensor sends a signal measuring the engine's revolutions and the crankshaft angle (not shown).

A coolant temperature sensor 14 is included as shown in FIG. 1. The coolant temperature sensor 14 communicates with the control unit 30 and the smart coolant control valve 200 to assist in regulating coolant flow throughout the engine as described in more detail herein. A combustion sensor 8 detects the vibrations produced by the combustion detonations and is also in communication with the control unit 30.

Accordingly, it is seen that a wide variety of sensors such as the injector head temperature sensors 1, distributor ignition timing sensors 2, admission manifold depression sensor 3, air intake sensor 4, battery voltage sensor 5, air intake manifold temperature sensor 6, crankshaft sensor 7, combustion sensor 8, air intake temperature sensor 9, throttle butterfly switch sensor 10, throttle sensor 11, air flow sensor 12, Oxygen sensor 13, and coolant temperature sensor 14 are all in communication with the control unit 30. It will be appreciated by those skilled in the art that the sensors shown are exemplary in nature and that a number of the described sensors could be eliminated, and additional sensors added, without departing from the present invention.

Figure 2:
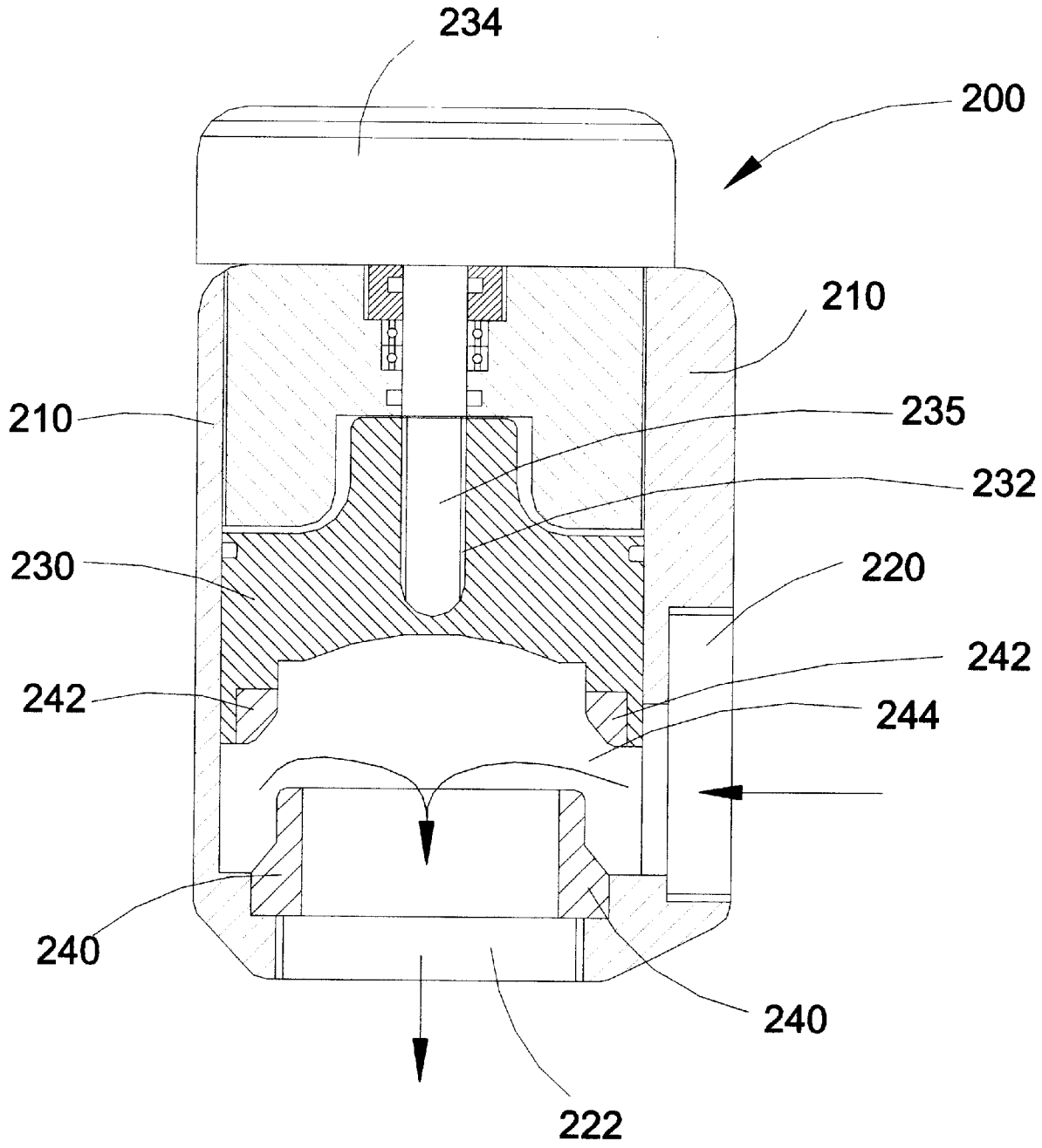
FIG. 2 is a cross-sectional view of the smart coolant control valve of FIG. 1 shown in a substantially open configuration.
Figure 3:
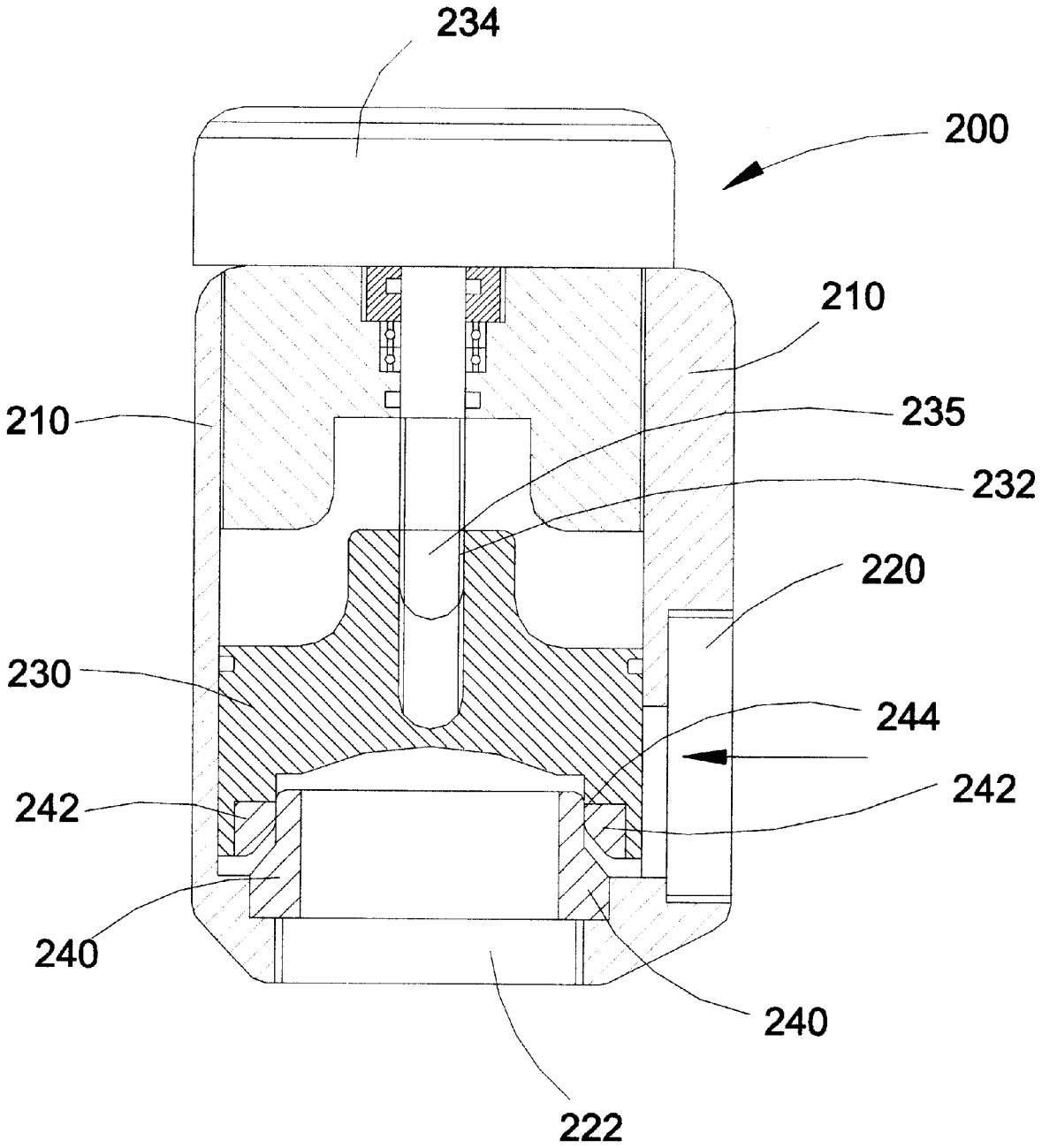
FIG. 3 is a cross-sectional view of the smart coolant control valve of FIG. 1 shown in a closed configuration.

In the preferred embodiment of the present invention, the smart fuel injection system 100 includes a smart coolant control valve 200, an illustrative cross-section of which is shown in FIGS. 2–3. The smart coolant valve 200 of the present invention is preferably configured to open and close in a controlled manner so as to permit a desired quantity of engine coolant to pass to the engine through a coolant flow aperture 244. The smart coolant control valve 200 preferably includes a main housing 210 defining an interior space therein and having an inlet port 220 and an outlet port 222 as shown. In the preferred embodiment, the main housing 210 is generally cylindrical in shape and will be configured to permit the controlled flow of engine coolant between the inlet port 220 and the outlet port 222 through the coolant flow aperture 244 as described in more detail herein.

The main housing 210 of the smart coolant control valve 200 may be constructed of any of a variety of known materials. In the preferred embodiment, the main housing 210 will be constructed of a heat resistant non-corrosive metallic material such as brass, for example, to protect internal components of the smart coolant valve 200 and extend their useful life. The main housing 210 will preferably include a plunger 230 configured to move axially in a controlled manner in a number of configurations including and between the substantially open configuration depicted in FIG. 2 and the closed configuration shown in FIG. 3.

A wide variety of means can be utilized to move the plunger 230 of the present invention in a controlled manner within the main housing 210 to control and regulate the quantity of engine coolant flowing between the inlet port 220 and the outlet port 222 of the main housing 210 of the smart coolant control valve 200. In one embodiment, the plunger 230 may include a threaded bore 232 disposed therein as illustrated in FIGS. 2–3 and configured to cooperate with a screw 235 so as to move the plunger 230 along an axis of the main housing 210 as shown. The screw 235 will preferably be operated by an electric motor 234, as shown, such that the plunger 230 can be strategically moved within the main housing 210, as desired, to carefully control the amount of engine coolant passing to the engine.

The plunger 230 and cooperating screw 235 may be constructed from a wide variety of different materials without departing from the present invention. Preferably, the plunger 230 and screw 235 will be formed of a metallic material such as steel. In the preferred embodiment, the smart coolant control valve 200 will have a lower seal 240 and an upper seal 242 so that the coolant flow aperture 244 of the smart coolant control valve 200 can be closed with a substantially leak proof seal to prevent, when desired, the passage of coolant to the engine as depicted in FIG. 3. The coolant control valve 200 is shown in FIG. 3 in an open configuration so that coolant is permitted to flow from the inlet port 220 to the outlet port 222 of the coolant control valve 200 through the coolant flow aperture 244.

Figure 4:
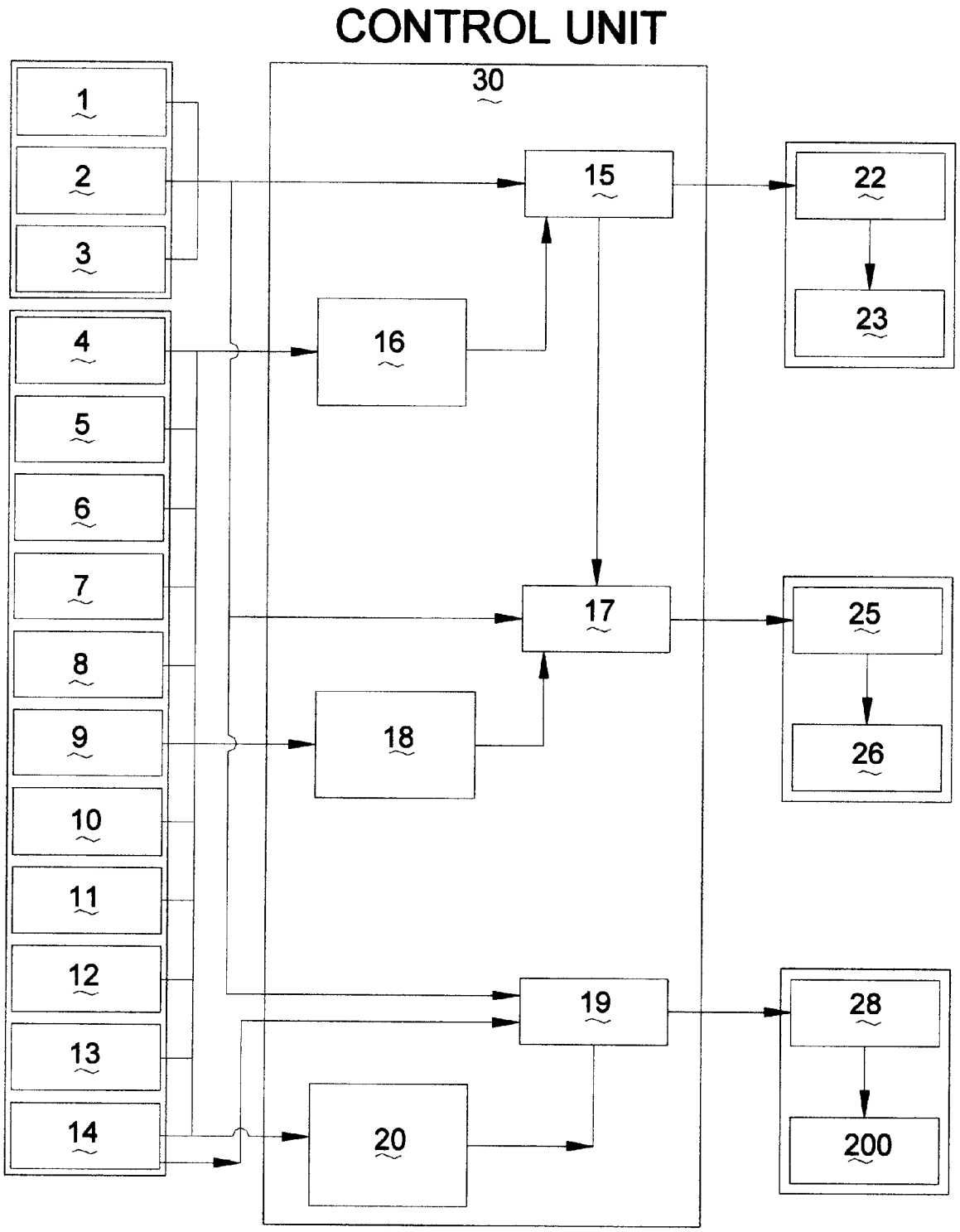
FIG. 4 is a schematic diagram showing the sensors of the smart fuel injection system in communication with the throttle butterfly, fuel injectors, and smart coolant control valve of the present invention.

Referring now primarily to FIG. 4, in the preferred embodiment, the control unit 30 outputs the signals that operate the injectors 26 through the fuel injector driver 25. The signals that operate the throttle butterfly 23 are sent from the control unit 30 to the throttle butterfly driver 22. Likewise, the smart coolant control valve 200 is controlled by the control unit 30 via signals sent to the coolant control valve driver 28.

In a preferred embodiment of the smart fuel injection system 100, a feedback correction coefficient calculator for the air intake quantity 16, as shown in FIG. 4, calculates a feedback correction coefficient based upon signals received from the air intake sensor 4, battery voltage sensor 5, air intake manifold temperature sensor 6, crankshaft sensor 7, combustion sensor 8, air intake temperature sensor 9, throttle butterfly switch sensor 10, throttle sensor 11, air flow sensor 12, oxygen sensor 13, and coolant temperature sensor 14. The feedback correction coefficient calculator for the air intake quantity 16 may be a distinct programmed microchip, if desired, or may be an algorithm or program incorporated into the control unit 30. It will be appreciated, of course, that a variety of other calculating means can also be utilized without departing from the present invention.

A feedback correction coefficient calculator for the fuel injection pulse width 18, as shown in FIG. 4, preferably calculates a feedback correction coefficient based upon signals received from the air intake sensor 4, battery voltage sensor 5, air intake manifold temperature sensor 6, crankshaft sensor 7, combustion sensor 8, air intake temperature sensor 9, throttle butterfly switch sensor 10, throttle sensor 11, air flow sensor 12, oxygen sensor 13, and coolant temperature sensor 14. The feedback correction coefficient calculator for the fuel injection pulse width 18 may be a distinct programmed microchip, if desired, or may be an algorithm or program incorporated into the control unit 30. It will be appreciated, of course, that other variations can also be utilized without departing from the present invention.

In a preferred embodiment of the smart fuel injection system 100, a feedback correction coefficient calculator for the smart coolant control valve 20, as shown in FIG. 4, calculates a feedback coefficient based upon signals received from the air intake sensor 4, battery voltage sensor 5, air intake manifold temperature sensor 6, crankshaft sensor 7, combustion sensor 8, air intake temperature sensor 9, throttle butterfly switch sensor 10, throttle sensor 11, air flow sensor 12, oxygen sensor 13, and coolant temperature sensor 14. The feedback correction coefficient calculator for the smart coolant control valve 20 may be a distinct programmed microchip, if desired, or may be an algorithm or program incorporated into the control unit 30. It will be appreciated, of course, that other variations can also be utilized without departing from the present invention.

Figure 5:
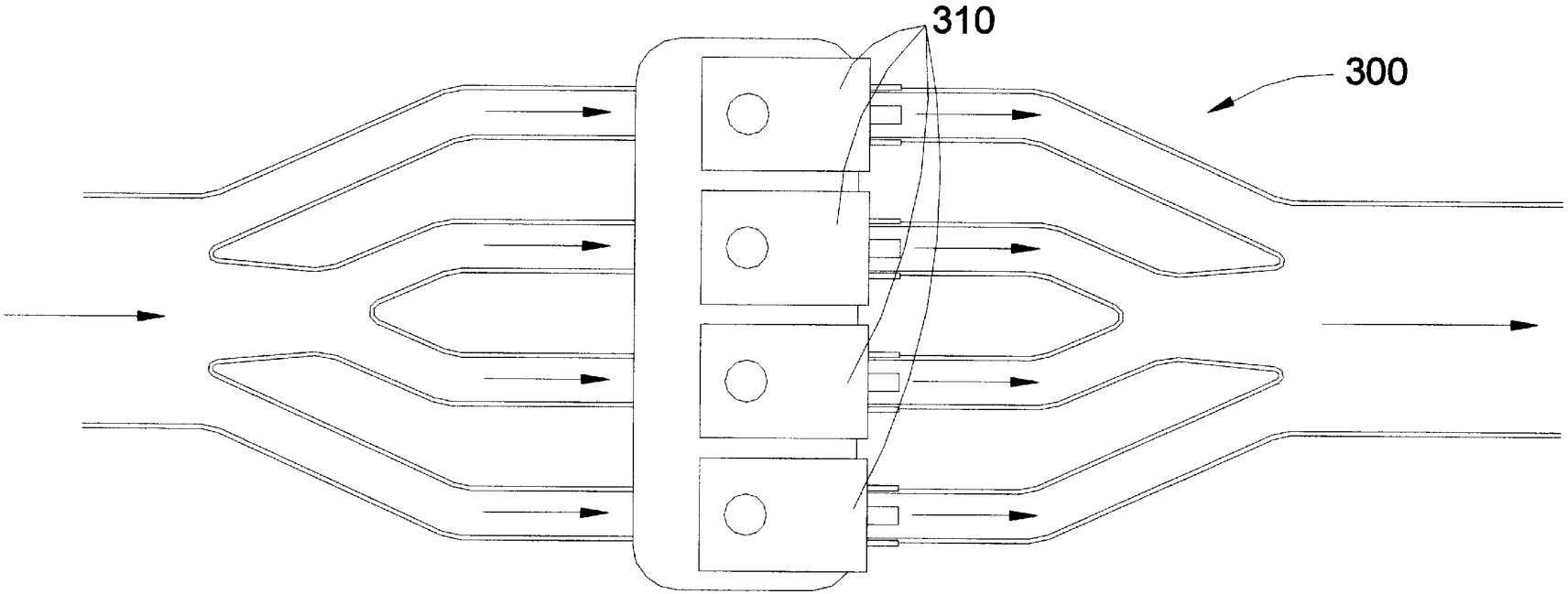
FIG. 5 is a schematic view of an alternative embodiment utilizing a number of conventional coolant control valves in parallel to form a coolant valve system in accordance with the present invention.

In an alternative embodiment of the present invention, the smart coolant control valve 200 of the present invention may be replaced with a coolant valve system 300 as shown in FIG. 5. Preferably, the coolant valve system 300 will include a plurality of conventional coolant valves 310 used in combination as shown in FIG. 5. It will be appreciated, however, that the coolant valve system 300 may be configured in a wide variety of ways without departing from the present invention. A cross-sectional view of one of the conventional coolant valves is shown in FIG. 5 in a closed configuration. A conventional coolant valve 310 of FIG. 5 is shown in FIG. 6 in an open configuration.

Figure 6:
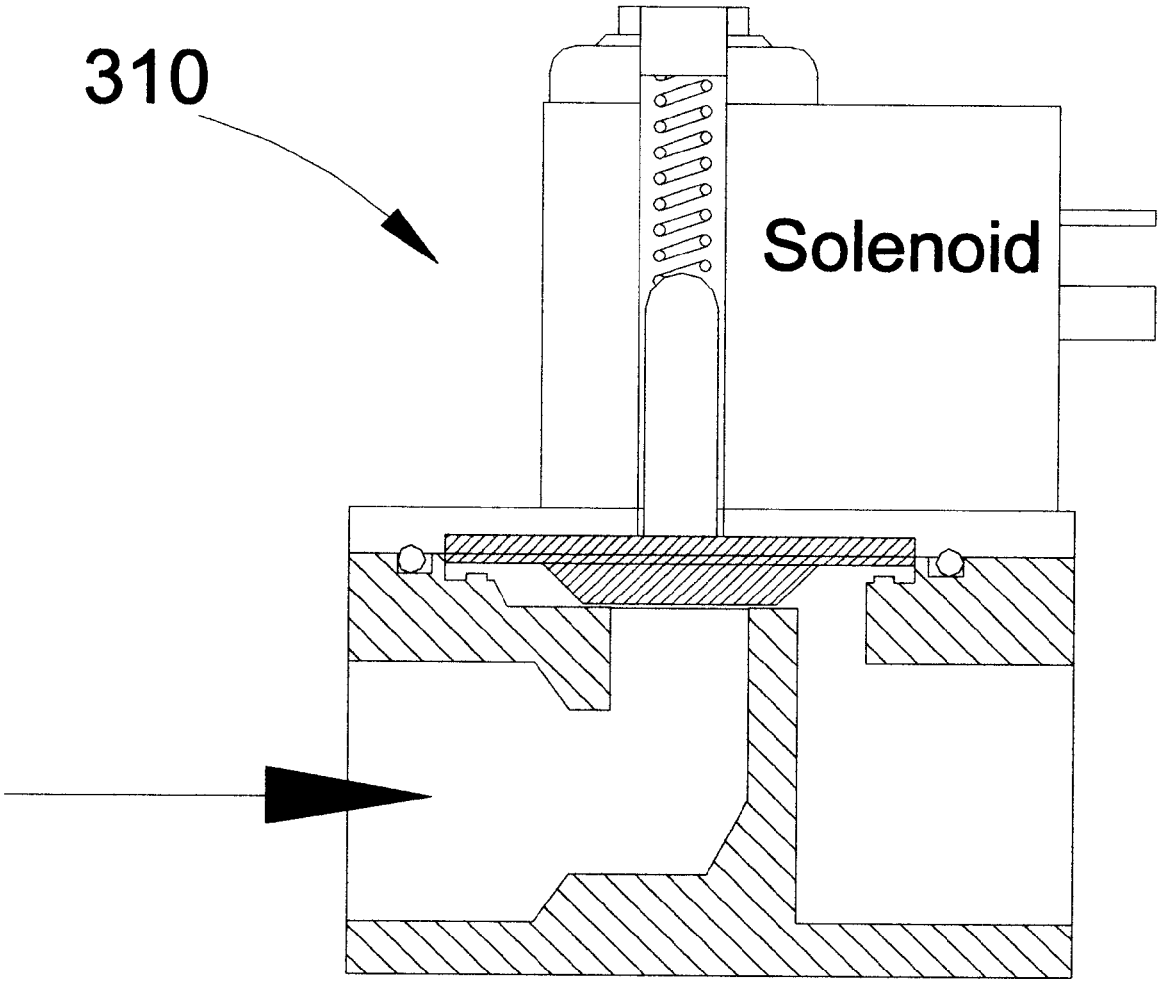
FIG. 6 is a cross-sectional view of one of the conventional coolant control valves of FIG. 5 shown in a closed configuration.
Figure 7:
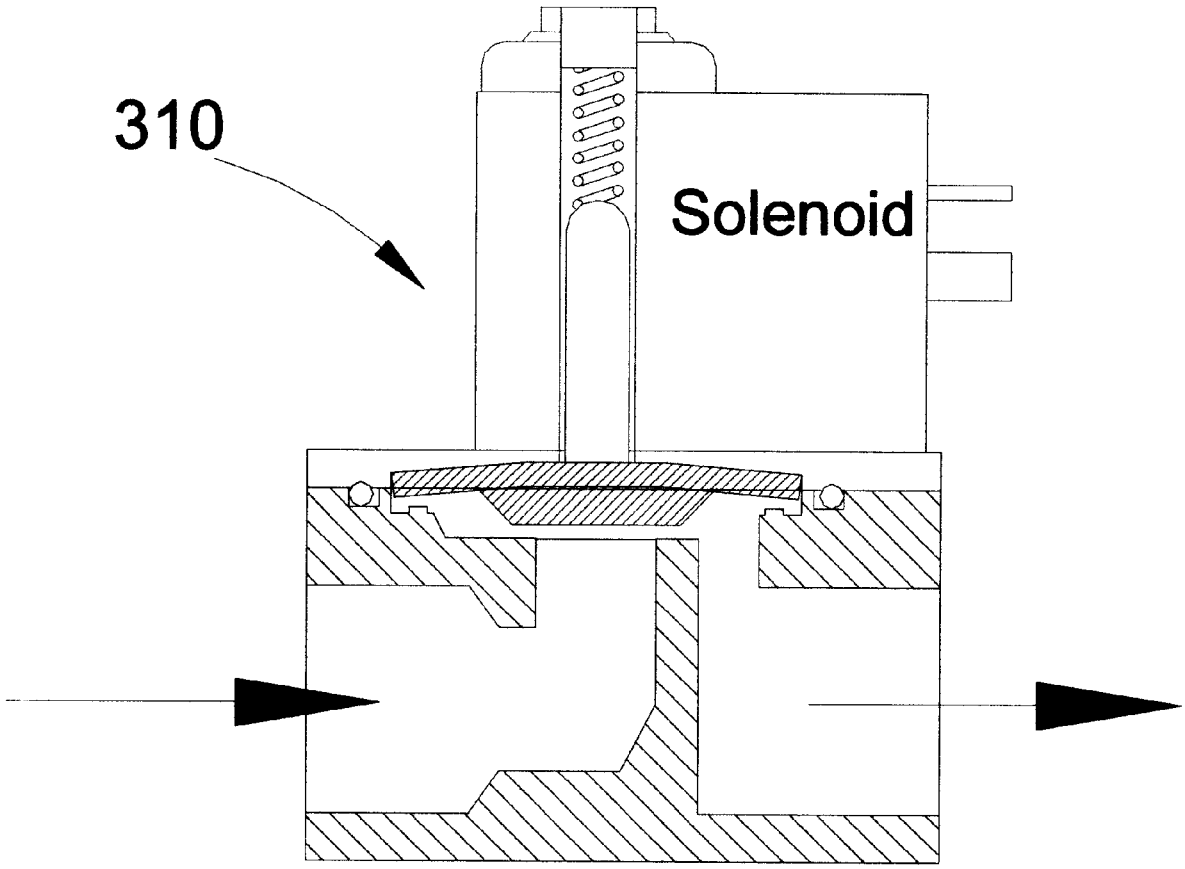
FIG. 7 is a is a cross-sectional view of one of the conventional coolant control valves of FIG. 5 shown in an open configuration.

Although four conventional coolant valves 310 are shown in the alternative embodiment illustrated in FIG. 6, it will be appreciated that any number of conventional coolant valves 310 may be utilized without departing from the present invention. In one embodiment, a number of conventional coolant valves 310 may be configured in parallel as shown in FIG. 5. These conventional coolant valves 310 are operable either in an open or closed configuration and are not able, individually, to control the exact amount of coolant passing to the engine. When placed in parallel as shown in FIG. 5, however, it is seen that the flow of the coolant can be controlled by varying the temperature at which each individual conventional coolant valve 310 opens. If desired, the temperature at which each of the conventional coolant valves 310 of the coolant valve system 300 can be varied, if desired, to obtain a level of control over the flow of coolant to the engine. If desired, each one of the conventional coolant valves 310 can be configured to individually receive an open or close command from the control unit 30 so that the flow of coolant can be regulated depending upon the number of conventional coolant valves 310 open at any given time.

Figure 8:
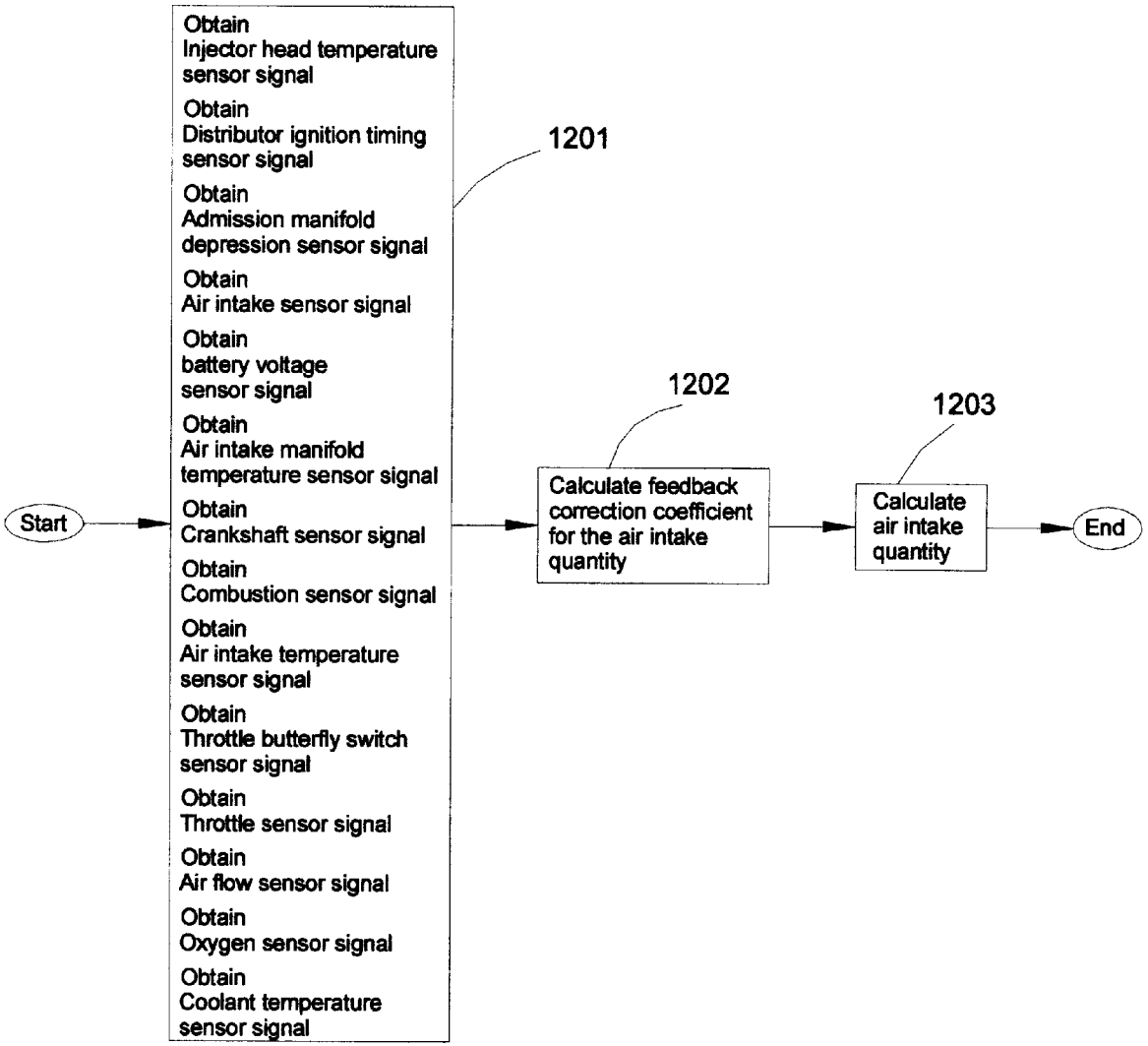
FIG. 8 is an illustrative flowchart showing one method of calculating the air intake quantity.

The smart fuel injection system 100 of the present invention present invention preferably calculates the air intake quantity as set forth in the illustrative flowchart of FIG. 8 using the air intake calculator 15. It will be understood by those skilled in the art, however, that the air intake quantity may be calculated in a wide variety of ways without departing from the present invention.

At step 1201, as illustrated in FIG. 8, signals are obtained from the injector head temperature sensor 1, the distributor ignition timing sensor 2, admission manifold depression sensor 3, air intake sensor 4, battery voltage sensor 5, air intake manifold temperature sensor 6, crankshaft sensor 7, combustion sensor 8, air intake temperature sensor 9, throttle butterfly switch sensor 10, throttle sensor 11, air flow sensor 12, Oxygen sensor 13, and coolant temperature sensor 14. Next, at step 1202, these signals are utilized to calculate the feedback correction coefficient for the air intake quantity. Finally, at step 1203, as shown in FIG. 8, the feedback correction coefficient for the air intake quantity is utilized along with signals 1–14 to calculate the air intake quantity and a signal is sent to the throttle butterfly driver 22 so that the throttle butterfly driver 22 is accurately controlled.

Figure 9:
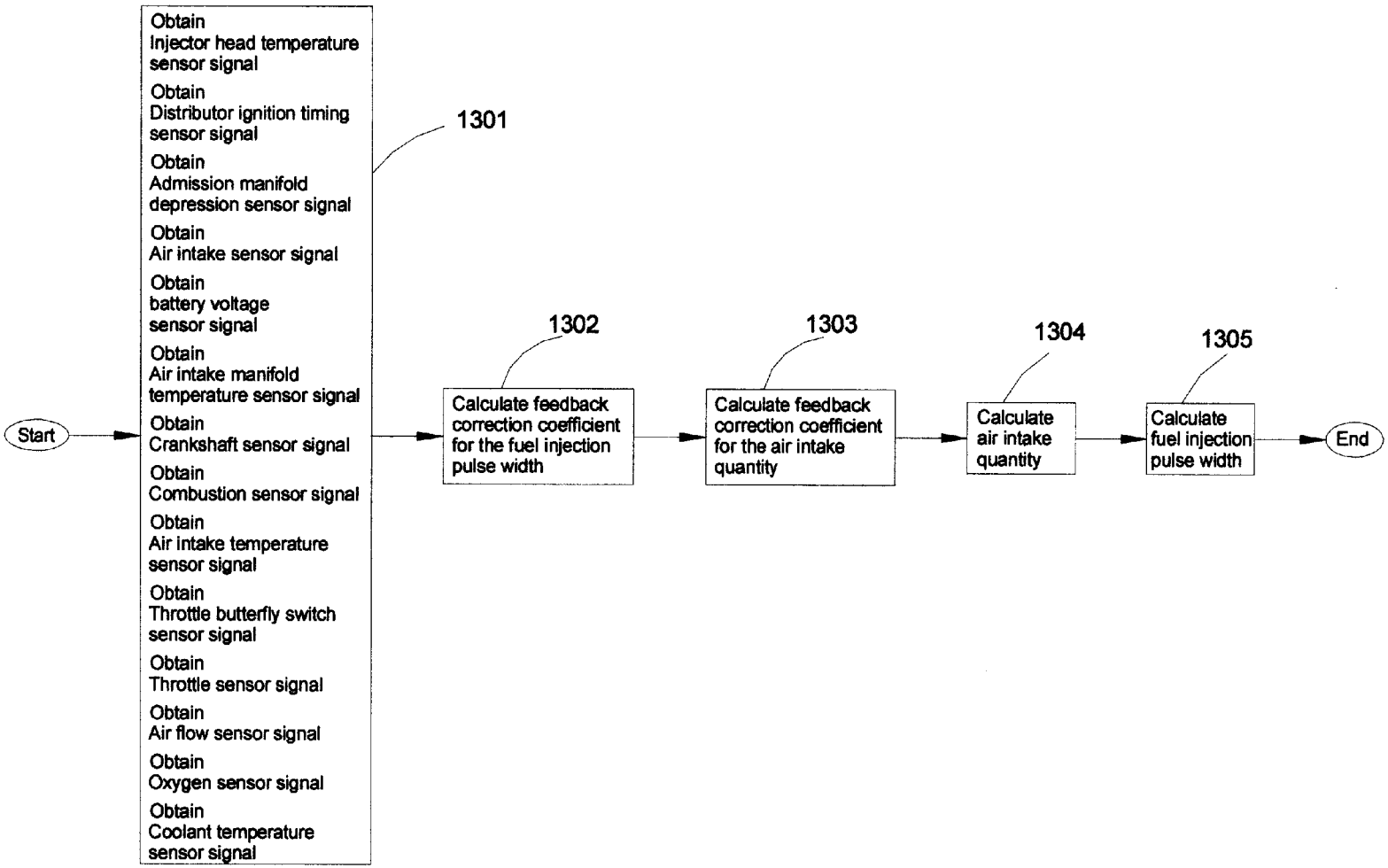
FIG. 9 is an illustrative flowchart showing one method of calculating the fuel injection pulse width.

In the preferred embodiment of the smart fuel injection system 100, the fuel injection pulse width is calculated as set forth in FIG. 9. Referring now primarily to FIG. 9, signals are obtained, as depicted in step 1301, from the temperature sensor 1, the distributor ignition timing sensor 2, admission manifold depression sensor 3, air intake sensor 4, battery voltage sensor 5, air intake manifold temperature sensor 6, crankshaft sensor 7, combustion sensor 8, air intake temperature sensor 9, throttle butterfly switch sensor 10, acceleration sensor 11, air flow sensor 12, Oxygen sensor 13, and coolant temperature sensor 14. Once the signals are obtained from sensors 1–14, a feedback correction coefficient for the fuel injection pulse width is calculated at step 1302. At step 1303, using the same signals obtained at step 1302, the feedback correction coefficient for the air intake quantity is calculated. This value is utilized at step 1304, to calculate the air intake quantity. At step 1305, the fuel injection pulse width is determined by the fuel injection pulse width calculator 17 with assistance from the feedback correction coefficient calculator for the fuel injection pulse width 18 and the air intake quantity calculator 15. The resultant signal is received by the fuel injector driver 25 which, accordingly, controls the pulse width of the fuel injectors 26.

Figure 10:
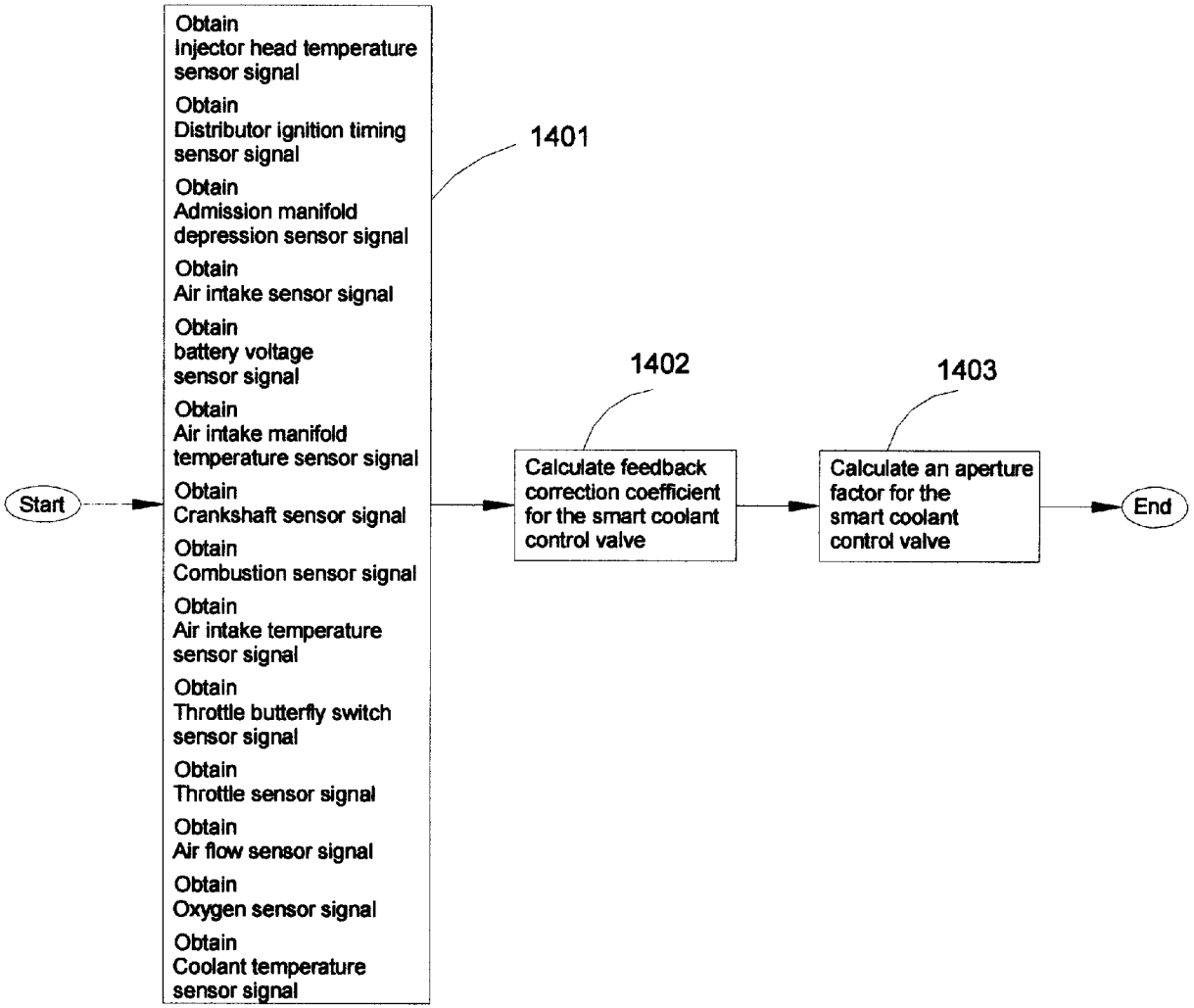
FIG. 10 is an illustrative flowchart showing one method of calculating the aperture factor for the smart coolant control valve of the present invention.

In the preferred embodiment of the smart fuel injection system 100 of the present invention as shown in FIGS. 2–3, the plunger 230 of the smart coolant control valve 200 can be moved axially to regulate the size of the aperture 244 and therefore the quantity of engine coolant flowing between the inlet port 220 and the outlet port 222 of the main housing 210 of the smart coolant control valve 200. An illustrative flowchart showing one method of calculating the size of the aperture 244 in the smart coolant control valve 200 is shown in FIG. 10. As shown, at step 1401, signals are obtained from the temperature sensor 1, the distributor ignition timing sensor 2, admission manifold depression sensor 3, air intake sensor 4, battery voltage sensor 5, air intake manifold temperature sensor 6, crankshaft sensor 7, combustion sensor 8, air intake temperature sensor 9, throttle butterfly switch sensor 10, throttle sensor 11, air flow sensor 12, Oxygen sensor 13, and coolant temperature sensor 14. Once the signals are obtained from sensors 1–14, the feedback correction coefficient for the smart coolant control valve 200 is calculated at step 1402 by the feedback correction coefficient calculator for the smart coolant control valve 20. The feedback correction coefficient for the smart coolant control valve 200 is then utilized, at step 1403 by the smart coolant control valve calculator 19, to calculate an aperture factor for the smart coolant control valve 200. This aperture factor is output to the coolant control valve driver 28 so that the size of the coolant valve aperture 244 can be varied as desired.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A smart fuel injection system for an automobile, comprising:

a multi-cylinder engine having at least one fuel injector;

an engine control unit configured to control multiple engine operations including air intake quantity, fuel injection pulse width, and coolant circulation;

a plurality of sensors disposed throughout said engine and in communication with said engine control unit;

said plurality of sensors including a plurality of injector head temperature sensors configured to directly measure a temperature at a head of each injector nozzle of each cylinder of said engine; and a smart coolant control valve in communication with said engine control unit and having a continuously adjustable coolant flow aperture therein and configured to regulate a quantity of engine coolant passing to said engine with substantial precision at anytime during operation of said engine, said smart coolant control valve further comprising:

a main housing defining an interior space and having an inlet portion and an outlet portion therein configured to permit engine coolant flow therebetween, said main housing having said adjustable coolant flow aperture therein, a plunger disposed within said main housing, plunger movement means configured to move said plunger in a controlled manner within said main housing to adjust a size of said coolant flow aperture, and an upper seal and a lower seal disposed within said main housing and defining said adjustable coolant flow aperture therebetween.

2. A smart fuel injection system as recited in claim 1, wherein said plurality of sensors further comprise:

a distributor ignition timing sensor;

an admission manifold depression sensor;

an air intake sensor;

a battery voltage sensor;

an air intake manifold temperature sensor;

a crankshaft sensor;

a combustion sensor;

an air intake temperature sensor;

a throttle butterfly switch sensor;

a throttle sensor;

an air flow sensor; and an Oxygen sensor.

3. A smart fuel injection system as recited in claim 1, wherein said coolant control means comprises a coolant valve system including a plurality of conventional coolant valves in parallel.

4. A smart fuel injection system as recited in claim 3, wherein said plurality of conventional coolant valves are in communication with said control unit.

5. A smart fuel injection system as recited in claim 3, wherein said plurality of conventional coolant valves are individually operable in either an open or closed configuration.

* * * * *